United States Patent [19]

Louret et al.

[11] Patent Number: 4,970,843

[45] Date of Patent: Nov. 20, 1990

[54] CARTON FLAP FOLDING MECHANISM

[75] Inventors: Gerard Louret, Ardentes; Andre Stahl, Mehun S/Yevre, both of France

[73] Assignee: The Mead Corporation, Dayton, Ohio

[21] Appl. No.: 287,182

[22] Filed: Dec. 20, 1988

[30] Foreign Application Priority Data

Dec. 21, 1987 [GB] United Kingdom ..... 8729777

[51] Int. Cl.[5] ..... B65B 11/10; B65B 21/24; B65B 27/04

[52] U.S. Cl. ..... 53/48; 53/381 R; 493/177

[58] Field of Search ..... 53/48, 381 R, 374, 590, 53/398; 493/177

[56] References Cited

U.S. PATENT DOCUMENTS

| | | | |
|---|---|---|---|
| 3,067,863 | 12/1962 | Schwinger | 493/177 X |
| 3,430,413 | 3/1969 | Wood | 53/48 |
| 3,543,473 | 12/1970 | Cato | 53/48 |
| 3,548,566 | 12/1970 | Sherman | 53/48 |
| 3,572,003 | 3/1971 | Perry | 53/48 X |
| 4,285,185 | 8/1981 | Collura et al. | 53/48 |
| 4,338,760 | 7/1982 | Kuhn | 53/48 |
| 4,554,778 | 11/1985 | Calvert . | |
| 4,563,853 | 1/1986 | Calvert | 53/48 |
| 4,566,248 | 1/1986 | Cooley | 53/48 |
| 4,651,502 | 3/1987 | Ganz | 53/48 X |

FOREIGN PATENT DOCUMENTS

| | | |
|---|---|---|
| 0171229 | 2/1986 | European Pat. Off. . |
| 0200445 | 11/1986 | European Pat. Off. . |

*Primary Examiner*—Horace M. Culver
*Attorney, Agent, or Firm*—Thomas A. Boshinski

[57] ABSTRACT

In a machine for packaging articles in a tubular wrap-around carrier formed from a blank having a pair of walls adjoined together along a fold line and having a pair of article retaining and blank reinforcing flaps disposed astride the fold line, and which includes means for advancing a blank and its associated articles along a predetermined path, a mechanism for engaging and folding the pair of flaps and to fold such flaps inwardly of the carrier. The folding mechanism comprises a pivotal folder 'f' adapted to execute a folding movement thereby progressively to enter an aperture in the blank to fold the flaps and to retract therefrom during feed movement of the blank and the pivotal folder together through a folding station of the machine.

9 Claims, 9 Drawing Sheets

CLOSED POSITION

TOP VIEW
PB1
P1
PM1
PG1
f
PG2
24
PA1
PF1
PF2
PA2
26
PM2
20
PB2
P2

OPEN POSITION
PB2
P2
f
26
22b
22
90°
PG2
PG1
PB1
PA2
PF2
24
22a
P1
PA1
PF1
20

PB1
30°
f
PG1
24
PA2
22
20
PA1
PF2
PF1

CARTON FLAP FOLDING MECHANISM

This invention relates to a mechanism of the type disclosed in European Patent Application No. 0 200 445 and more specifically to the carton blank folding devices including pivotal folders included therein. Such pivotal folders are used to fold bottle retaining and blank reinforcing flaps which define bottle heel receiving apertures, into overlapping relationship with adjacent portions of the carton blank to which they are hinged. Such retaining and reinforcing flaps are incorporated in the carton blank shown in European patent Application No. 0 171 229. This flap folding operation is performed while the carton blank is advanced together with the folding devices of the mechanism through the infeed end of a packaging machine.

In the known construction, each pivotal folder comprises a pair of blank engaging pivotal fingers arranged to open and close together in response to movement of a spherical cam follower, forming a part of the pivotal folder, along a cam track. In order to perform the flap folding operation, the pivotal fingers are pivoted into one extreme outward position in which the fingers are caused to move apart together to engage and fold the carton flaps of a bottle heel retaining aperture and are thereafter pivoted into a fully retracted position in which the fingers are caused to close together.

However, it has been found that there is a tendency for the known pivotal fingers to strike the bottles or other articles to be packaged, resulting in a bottle breakage risk and/or likelihood of an incomplete flap folding operation. The present invention seeks to alleviate this problem and to create an improved folding action by causing the pivotal fingers to move downwardly during their opening movement.

To this end, one aspect of the invention provides in a machine for packaging articles in a tubular wrap-around carrier formed from a blank having a pair of walls adjoined together along a fold line and having a pair of article retaining and blank reinforcing flaps disposed astride said fold line and which includes means for advancing a blank and is associated articles along a predetermined path, a mechanism for engaging and folding said pair of flaps and to fold such flaps inwardly of the carrier, said folding mechanism comprising a folder adapted to execute a folding movement thereby progressively to enter an aperture defined at least partially by said pair of flaps, in the blank to fold the flaps and to retract therefrom during feed movement of the blank and said folder together through a folding station of the machine, said folder including a pair of blank engaging fingers and means for cooperation with actuating means to cause opening and closing movement of said fingers, characterized in that said pair of fingers are interconnected for the opening and closing movement together during said folding and retracting movements respectively, and in that said cooperating means is carried by each of said pair of fingers, the cooperating means of one finger controlling said opening movement of the pair of fingers, and the cooperating means of the other finger controlling said closing movement of the pair of fingers.

Another aspect of the invention comprises, in a machine for packaging articles in a tubular wrap-around carrier formed from a blank having a pair of walls adjoined together along a fold line and having a pair of article retaining and blank reinforcing flaps disposed astride said fold line and which includes means for advancing a blank and its associated articles along a predetermined path a method of folding said pair of flaps inwardly of the carrier, in which a folding mechanism comprising a folder is adapted to execute a folding movement thereby progressively to enter an aperture defined at least partially by said pair of flaps, in the blank to fold the flaps and to retract therefrom during feed movement of the blank and said folder together through a folding station of the machine, characterised in that said pair of fingers are caused to open and close together during said folding and retracting movements respectively, and in that one of said fingers controls said opening movement of the pair of fingers, and the other of said fingers controls said closing movement of the pair of fingers.

An embodiment of the invention will now be described, by way of example, with reference to the accompanying drawings, in which:

FIG. 1*a* is a plan view of a folder of the mechanism in which a pair of pivotal fingers are shown in closed position;

FIG. 1*b* is a perspective view of the folder as seen remote from the pivotal fingers.

FIG. 1*c* is a side view of the folder;

FIG. 2*a* is a plan view of the folder in which the pivotal fingers are shown in open position;

FIG. 2*b* is a perspective view of the folder showing pivotal fingers;

FIG. 2*c* is a plan view of the folder as seen with the pivotal fingers open;

Figure 6:
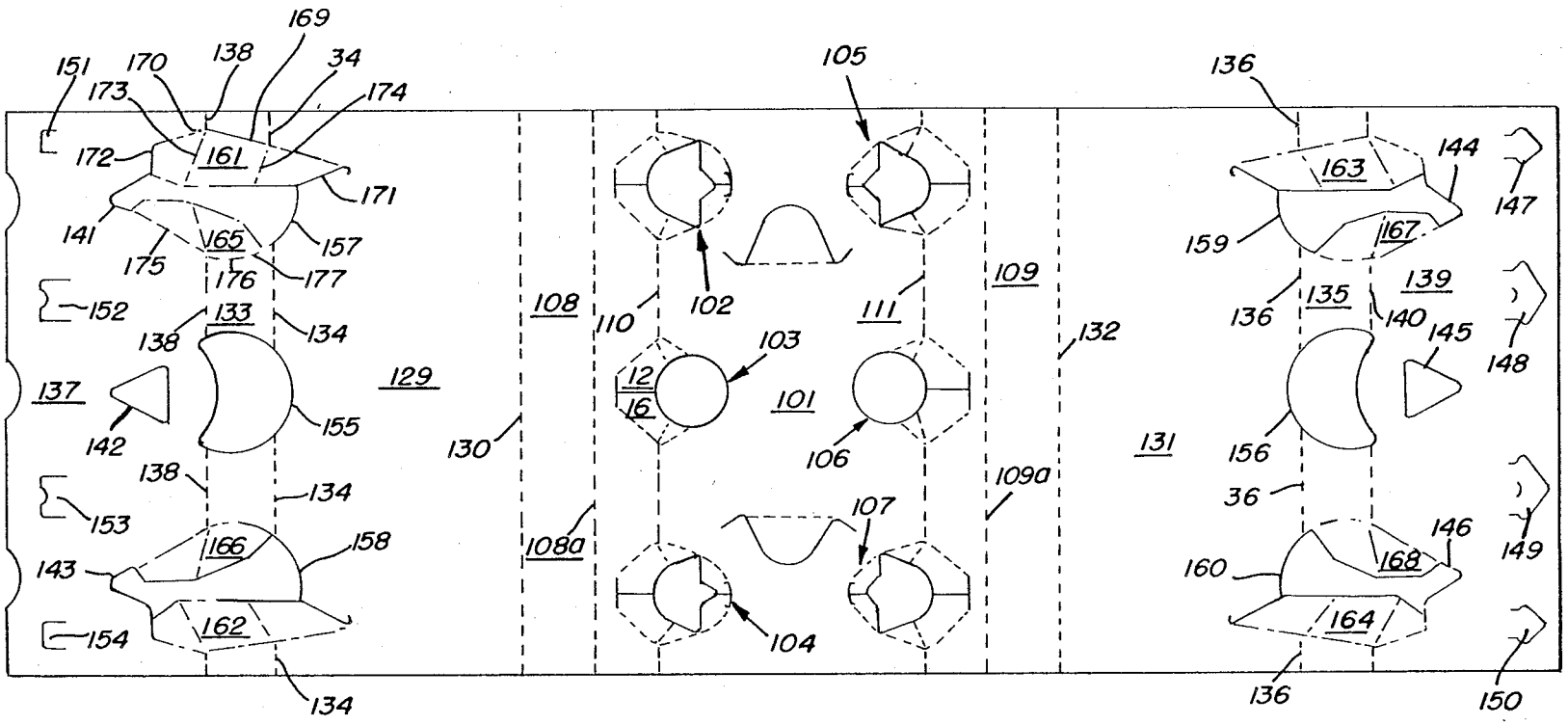
FIG. 6 is a plan view of a blank with which the present invention may be used.

As set forth in European Patent Application No. 0,171,229, a carton blank with which the present invention may be used is shown in FIG. 6, and includes a top wall generally designated by the numeral 101 in which bottle neck receiving apertures 102–107 are formed. These apertures may extend somewhat into the sloping shoulder panels 108 and 109 which are foldably joined to the side edges of top wall 101 along fold lines 110 and 111 respectively. Fold lines 108*a* and 109*a* may be formed in sloping panels 108 and 109 respectively to adapt the wrapper to certain bottle shapes.

Side wall 129 is foldably joined to sloping shoulder panel 108 along fold line 130 while side wall 131 is foldably joined to sloping shoulder panel 109 along fold line 132.

Sloping heel panel 133 is foldably joined to the bottom edge of side wall 129 along interrupted fold line 134 while sloping heel panel 135 is foldably joined to the bottom edge of side wall 131 along interrupted fold line 136.

Bottom lap panel 137 is foldably joined to the bottom edge of sloping heel panel 133 along interrupted fold line 138 while bottom lap panel 139 is foldably joined to the bottom edge of sloping heel panel 135 along interrupted fold line 140.

For tightening the wrapper about a group of articles, tightening apertures 141, 142 and 143 are formed in lap panel 137 while similar tightening apertures 144, 145 and 146 are formed in lap panel 139. With the wrapper disposed about a group of articles and with the lap panels 137 and 139 disposed in overlapping relationship, machine elements enter the tightening apertures and move toward each other so as to tighten the wrapper about the group of articles as is well known.

After the wrapper is tightened, it is locked by means of locking tabs 147–150 which are driven through the apertures defined by retaining tabs 151–154 respectively. The configurations of the locking and retaining tabs are well known, and the locking operation is well understood.

Conventional bottle heel receiving apertures 155 and 156 are disposed astride the heel sloping panels 133 and 135 respectively as shown in FIG. 6.

Bottle heel receiving apertures 157 and 158 are disposed astride the sloping heel panel 133 and extend into adjacent portions of side wall 129 and of lap panel 137 as is shown in FIG. 6. The tightening aperture 141 constitutes an extension of bottle heel receiving aperture 157 while tightening aperture 143 constitutes an extension of bottle heel receiving aperture 158.

In like fashion bottle heel receiving aperture 159 as well as bottle heel receiving aperture 160 are disposed astride the sloping heel panel 135 and extend into the lower portions of side wall 131 and into the adjacent portions of lap panel 139. Tightening aperture 144 constitutes an extension of bottle heel receiving aperture 159 while tightening aperture 146 constitutes an extension of bottle heel receiving aperture 160.

Bottle engaging carton reinforcing flaps 161–168 are formed into the carton blank. Flaps 161–164 are identical, and a detailed description of 161 only is here included. Similarly flaps 165–168 are identical, and a description of flap 165 only is herein included.

Bottle engaging carton reinforcing flap 161 is foldably joined to the carton along fold lines 169 and 170 which are angularly related and which intersect at fold line 138. A slit 171 separates one end of flap 161 from side wall 129 while a slit 172 separates the other end of flap 161 from lap panel 137.

For facilitating manipulation of the wrapper about an article group and to enhance the cooperation of the flap 161 with the associated bottle, a fold line 173 is formed in flap 161 one end of which coincides with the fold line 138. Similarly a fold line 174 is formed in flap 161 and is disposed in substantially parallel relation with the fold line 173 although these lines may not precisely parallel with each other.

When the carrier is assembled with the flap 161 in engagement with an associated bottle, the fold line 173 is disposed adjacent to and lies in a plane which is in substantially parallel relation with the lap panel 137.

Bottle engaging and carton reinforcing flap 165 is foldably joined to lap panel 137 along fold line 175 and to sloping heel panel 133 along fold line 176. A slit 177 separates a curved end portion of flap 165 from sloping heel panel 133.

Figure 7:
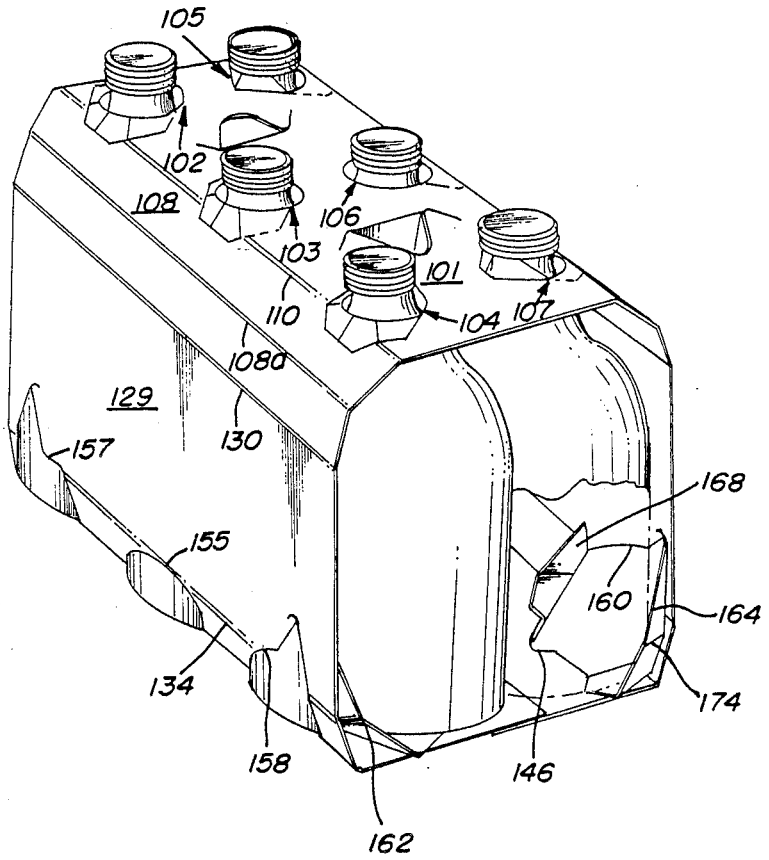
FIG. 7 is a perspective view of a set up carton formed from the blank of FIG. 6.
Figure 8:
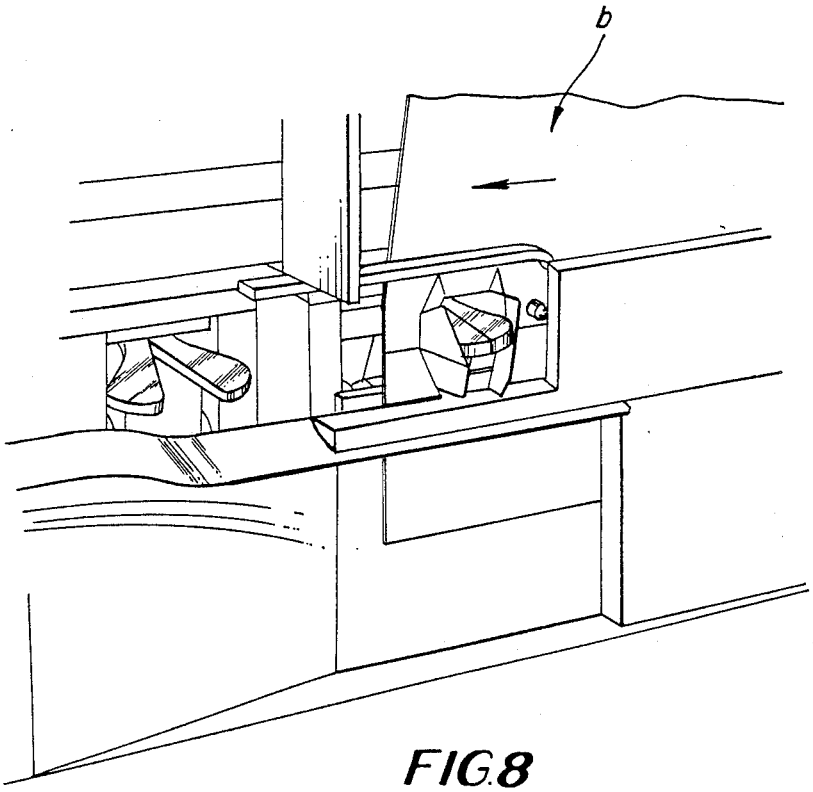
FIGS. 8 through 12 are sequential views of the folding station of a prior art mechanism of the type to which this invention relates.
Figure 9:
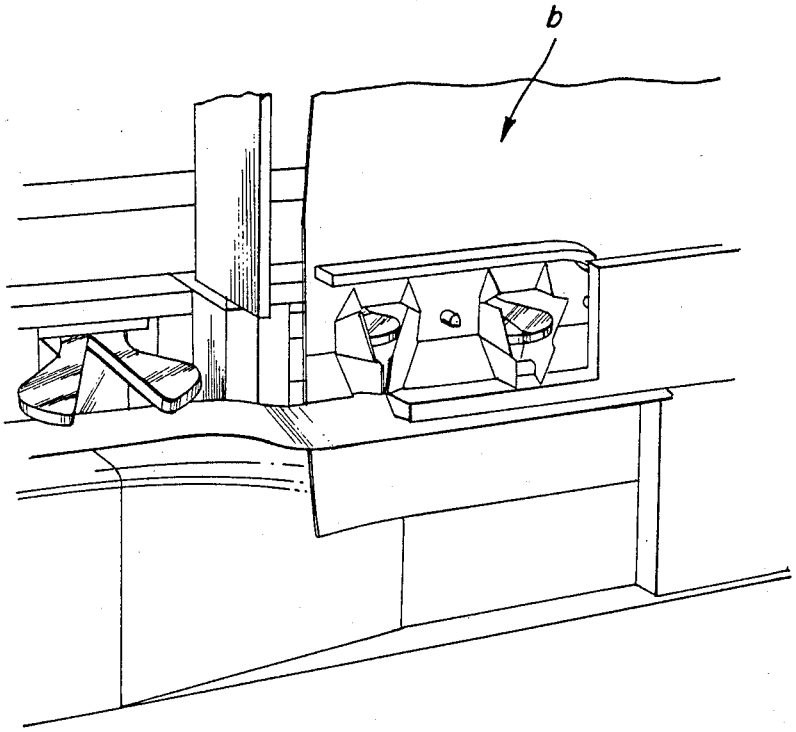
Figure 10:
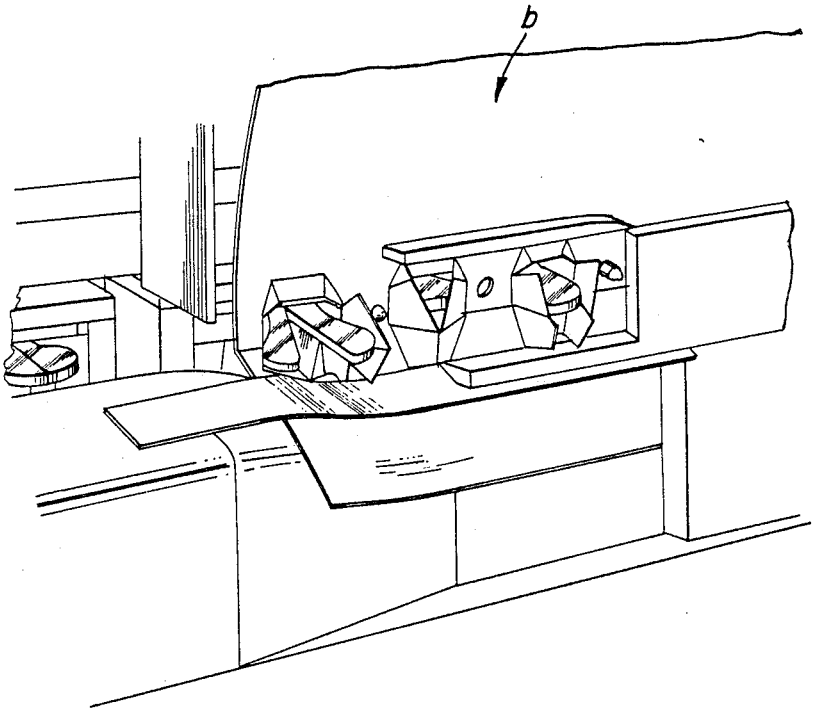
Figure 11:
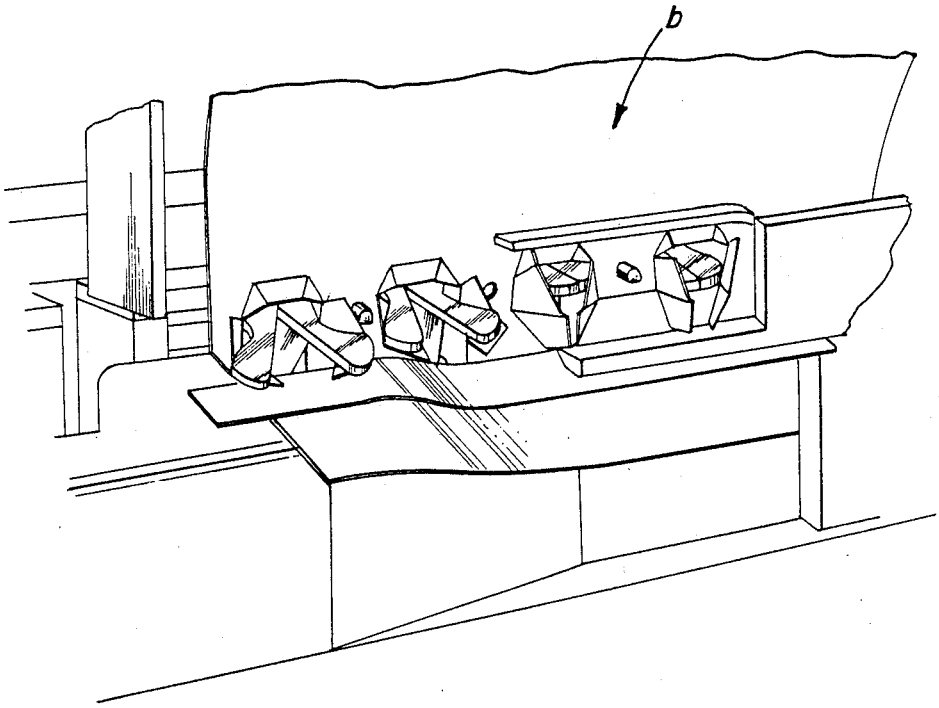
Figure 12:
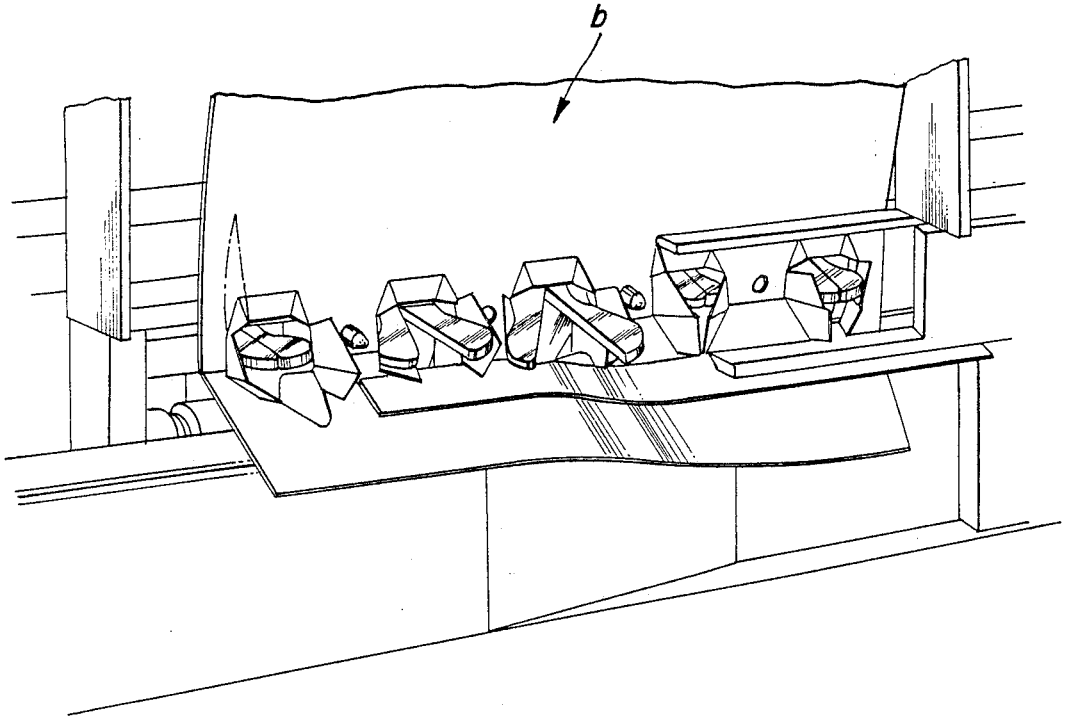

In order to form a package such as is shown in FIG. 7 from the blank such as is shown in FIG. 6, a blank is simply lowered from above onto the package in such manner that the bottle necks enter the bottle neck receiving apertures 102–107. Thereafter the side walls 129 and 131 and the associated sloping shoulder panels 108 and 109 and lap panels 137 and 139 are folded downwardly. Suitable machine elements enter the apertures 157–160 and manipulate the flaps 161–169 inwardly of the wrapper and so as to provide space between each pair of flaps such as 161 and 165 for receiving the heels of adjacent bottles as the side walls 129 and 131 are folded into close proximity with the bottle group and so as to cause the lap panel 137 to swing under the bottle group. Simultaneously, the lap panel 139 is folded underneath lap panel 137. Thereafter the blank is tightened and locked as previously explained.

The bottle engaging carton reinforcing flaps 161–168 are manipulated by machine elements such as described in U.S. patent application Ser. No. 636,831 filed Aug. 1, 1984, now U.S. Pat. No. 4,554,778. Also, the carton is manipulated from a hopper onto the package so as to cause the bottle neck receiving apertures 102–107 to envelop the bottle necks by suitable mechanism disclosed and claimed in U.S. patent application Ser. No. 636,830 filed Aug. 1, 1984, now U.S. Pat. No. 4,563,853.

Figure 5:
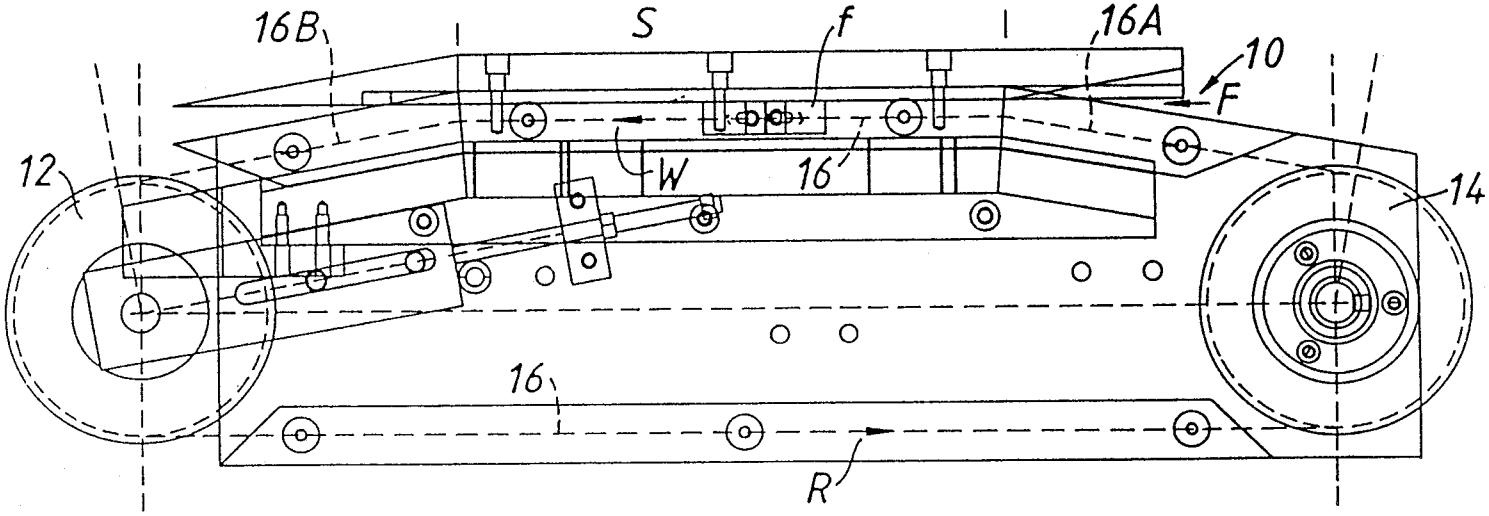
FIG. 5 is a plan view of the mechanism in which the folders are carried by an endless chain.

Referring now to FIG. 5 of the drawing, the blank folding mechanism 10 comprises a chain and sprocket set comprising spaced sprockets 12 and 14 respectively, about which is entrained endless chain 16.

The blank folding mechanism is adapted to be installed adjacent the infeed end of a packaging machine. Two such mechanisms are installed in side-by-side relationship so that a blank and article feed path is provided between the mechanisms. The description hereinafter refers to one such mechanism of the pair.

A series of carton blank folders 'f' are secured to the endless chain at spaced locations along its length so that successive bottle retaining and blank reinforcing flaps in a carton blank can be folded as the blank passes through the mechanism.

The endless chain 16 is driven in synchronism with the blank feed and thus each folder is moved along the chain paths at the same speed as a carton blank passing through the mechanism. In operation of the mechanism each blank folder is moved by the chain 16 along a working path 'W' parallel to a blank and article feed path 'F' and thereafter along a return path 'R'. As a folder approaches the working path 'W', it moves along a convergent path 16A so that the pivotal fingers of the folder are progressively caused to enter a bottle heel aperture of the carton blank.

As set forth in European patent application No. 0,200,445, FIGS. 8 to 12 are sequential views of folding station of a prior art mechanism of the type to which this invention relates, showing pivotal folders executing a folding and retracting movement in relation to a carton blank "b".

Referring to FIGS. 1*a*–1*c* and 2*a*–2*c*, each folder 'f' comprises a support block 20 including a central raised portion 22 on which the pivotal fingers P1 and P2 are supported. The central raised portion comprises upwardly convergent flats 22*a* and 22*b* from which extend pivot shafts 24 and 26 respectively such that the angle subtended between the axes of the pivot shafts is 53.13 degrees. It has been found that this angle gives the requisite downward component of travel of the pivotal fingers during their opening movement.

Figure 1A:
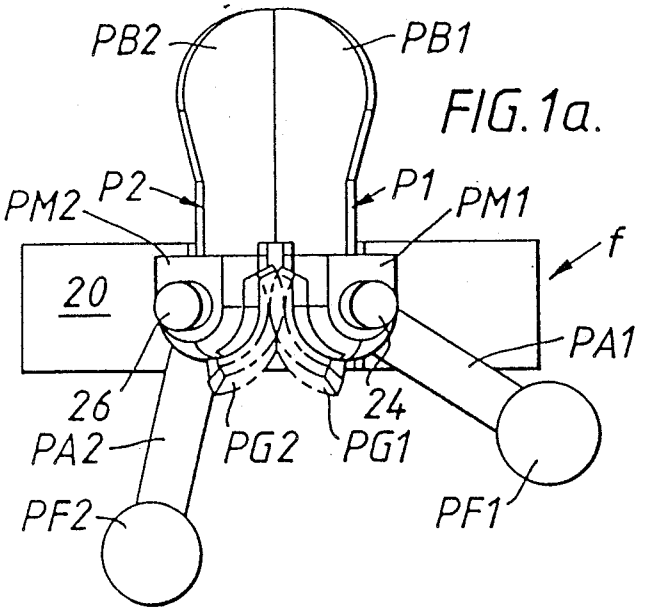
Figure 1B:
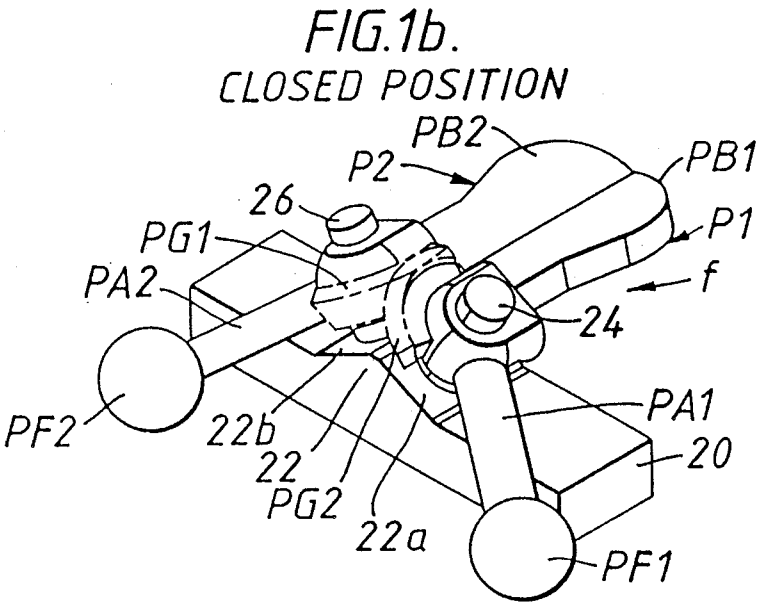
Figure 1C:
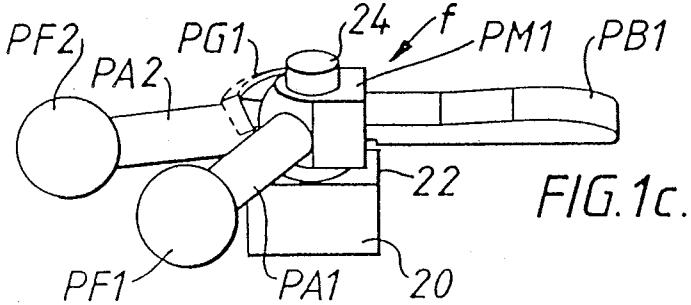
Figures 2A, 2B, 2C:
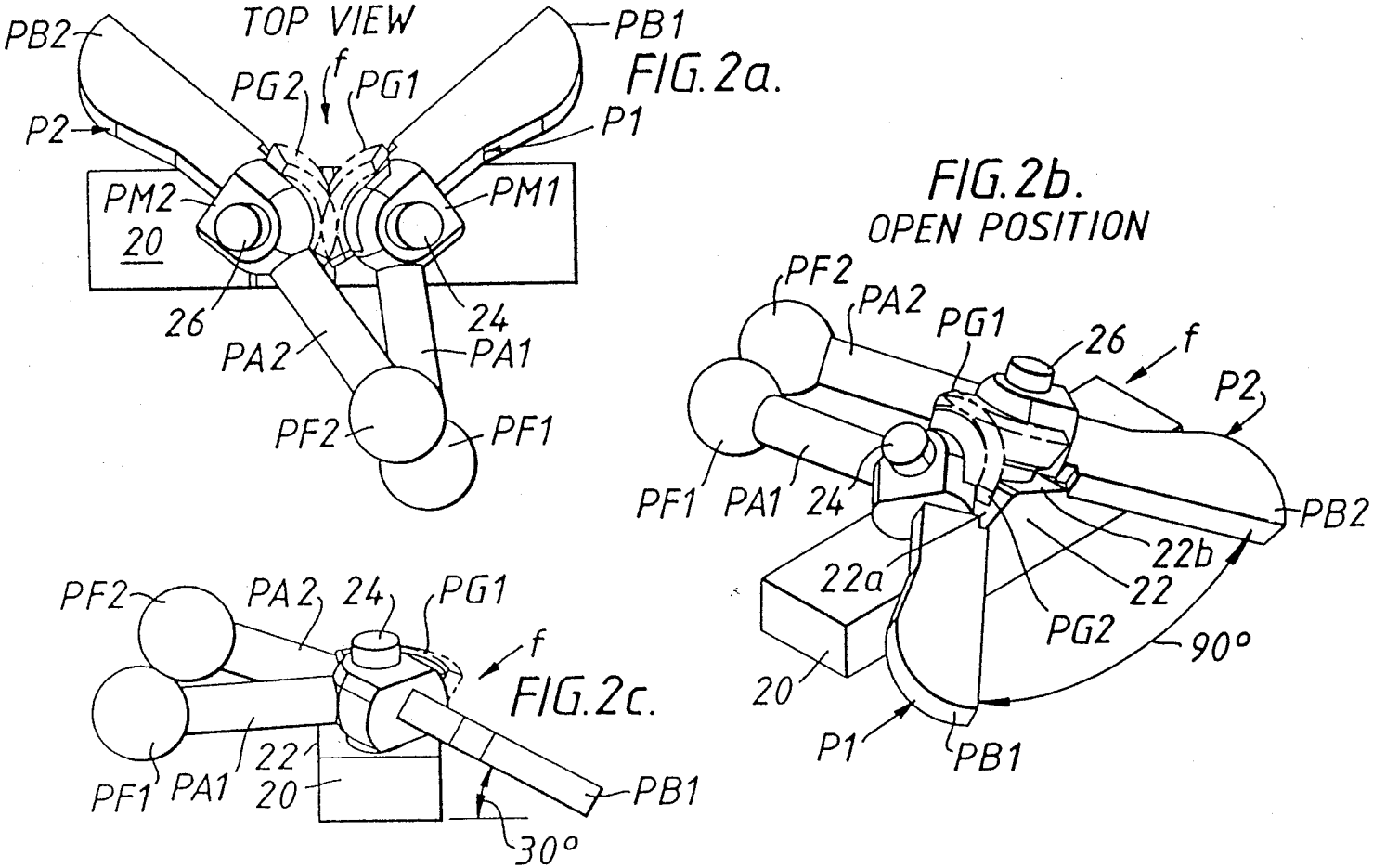

The pivotal fingers P1 and P2 are mounted on respective ones of the pivot shafts 24 and 26 by a bored through mid-portion PM1 and PM2. Each of the mid-portions are formed with a bevel gear segment PG1 and PG2 which meshes with the gear segment of the other pivotal finger. Thus, clockwise rotation of pivotal finger P1 causes simultaneous anti-clockwise rotation of pivotal finger P2. The pivotal fingers further include carton blank engaging portions PB1 and PB2 extending in one direction (forwardly) of the mid-portions of the respective pivotal fingers and actuating arms PA1 and PA2 extending in the opposite (rearward) direction of the mid-portions of the respective pivotal fingers. Both actuating arms terminate in spherical cam followers PF1 and PF2. As best seen in FIGS. 1*c* and 2*c*, actuating arm PA1 lies in a plane which is above that occupied by the actuating arm PA2 such that the arms can be caused to move relative to one another without mutual interference as described below. The inclined mounting of the pivotal fingers on the convergent flats 22*a* and 22*b* of the support block results in an arrangement in which the blank engaging portions of the fingers extend substantially horizontally from the mounting block when the blank engaging portions are closed, as shown in FIGS. 1*a*–1*c*, and in which the blank engaging portions are inclined downwardly when fully opened to 90 degrees as shown in FIGS. 2*a*–2*c*. The angle subtended between the plane containing each blank engaging portion of a finger and a plane containing the base of the mounting block is substantially 30 degrees when the fingers are fully open. Thus, when the fingers are open, the blank engaging portions move apart and progressively downwardly to their fully opened 90 degrees condition. This opening action has been found to minimise the risk of bottle contact by the blank engaging portions of the fingers and also to improve proper folding of the bottle retaining and blank reinforcing flaps. The 30 degrees angle is chosen to coincide with the plane containing the carton panel against which the flaps are to be folded.

Figure 3:
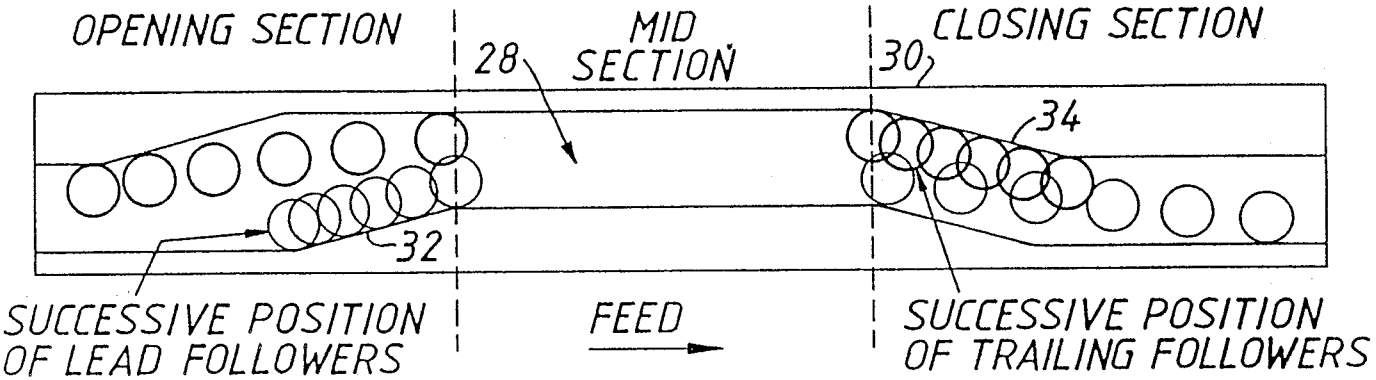
FIG. 3 is a plan view of a cam track through which cam followers of the folders move to cause opening and closing movement of the pivotal fingers.
Figure 4:
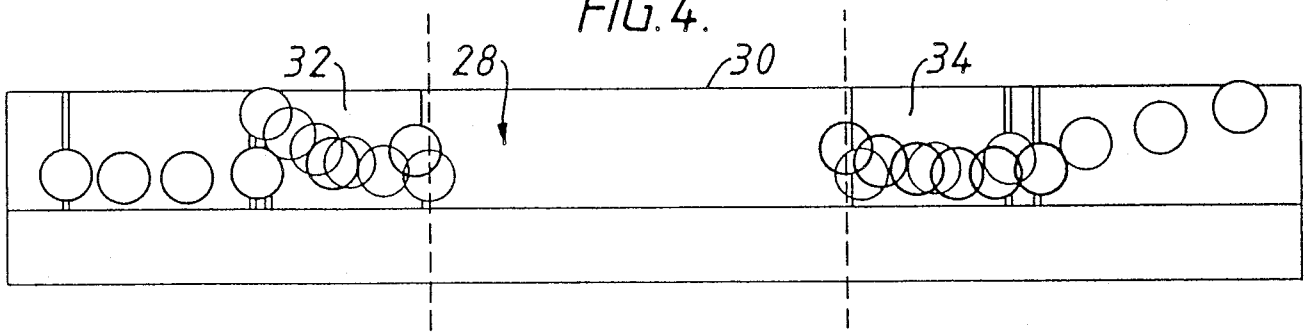
FIG. 4 is a front elevation of the cam track.

Referring now also to FIGS. 3 and 4, the pivotal fingers are actuated by a cam track 28 formed in a cam block 30 disposed alongside the feed path 'F' and adapted to receive the actuating arms and cam followers of the pivotal fingers as each folder passes through the working path 'W'.

The pivotal action is now described in which the pivotal finger P1 of a folder leads movement in the feed direction shown and pivotal finger P2 trails. A series of successive positions of the respective spherical cam followers is shown schematically in the cam track 28. As the actuating arms of a folder enters the cam track, in closed position, the cam follower PF1 strikes inclined cam surfaces 32 in the 'opening section' of the track which causes the actuating arm PA1 to move in opposition to the feed direction and towards the neighbouring actuating arm PA2. This pivotal action causes simultaneous movement of the blank engaging portions of the pivotal fingers away from one another by virtue of the geared connection between the fingers thereby bringing the pivotal fingers into their opened position. The other cam follower PF2 has a clear path of movement through the opening section of the cam track.

A straight mid-section of the cam track allows the fingers to be maintained in the open condition.

The actuating arms then enter a 'closing section' of the cam track in which the cam follower PF2 strikes inclined cam surface 34 which causes actuating arm PA2 to move in opposition to the feed direction and away from the neighbouring actuating arm PA1. This pivotal action causes simultaneous movement of the blank engaging portions of the pivotal fingers to move towards one another thereby returning the pivotal fingers to their closed position. Of course, immediately prior to the opening section, the convergent chain path 16A of movement of the folders towards the feed path of the carbon blank causes the blank engaging portions of each folder progressively to enter a carton bottle heel retaining aperture thereby displacing and folding the carton flaps during movement of the fingers through the opening section of the cam track. The fingers remain engaged in the carton in opened position through the mid section of the cam and are thereafter progressively retracted during movement of the pivotal fingers through the closing section of the cam track by virtue of the divergent chain path 16*b*.

What is claimed is:

1. In a machine for packaging articles in a tubular wrap-around carrier formed from a blank having a pair of walls adjoined together along a fold line and having a pair of article retaining and reinforcing flaps disposed astride said fold line, said flaps defining therebetween at least partially an aperture in said blank, said machine including advancing means for advancing a blank and articles associated therewith along a predetermined path, a folding mechanism for engaging and folding said pair of flaps to fold said flaps inwardly of the carrier, said folding mechanism comprising:

a pair of blank engaging fingers;

support means for pivotally mounting said fingers; interconnecting means for interconnecting said fingers whereby pivotal movement of one of said fingers causes corresponding pivotal movement of the other of said fingers;

means for advancing said fingers and said support means in conjunction with advancement of said blank by said advancing means;

means for progressively moving said fingers into said aperture for folding of said flaps and for subsequently retracting said fingers from said aperture; and actuating means and cooperating means, said cooperating means carried by said fingers, for cooperatively pivotally opening and closing said fingers during folding and retracting movement of said fingers, respectively, such that said cooperating means of one of said fingers controls opening of said fingers and said cooperating means of the other of said fingers controls closing of said fingers.

2. A folding mechanism according to claim 1, wherein said actuating means and said cooperating means are further for causing downward pivotal movement of said fingers during opening thereof.

3. A folding mechanism according to claim 2, wherein said support means defines a pair of upwardly convergent surfaces, said fingers being pivotally mounted one on each of said surfaces to thereby produce downward pivotal movement during opening of said fingers.

4. A folding mechanism according to claim 3, wherein said actuating means, said cooperating means and said upwardly convergent surfaces are configured to cause said finger to open through an angle of substantially 90 degrees and to pivot downwardly through an angle of substantially 30 degrees.

5. A folding mechanism according to claim 1, wherein said actuating means includes a cam track disposed adjacent said advancing means, and said cooperating means includes an actuating arm connected to each of said fingers for camming movement in contact with said cam track.

6. A folding mechanism according to claim 5, wherein said actuating arm of one of said fingers is disposed in a different plane from said actuating arm of the other of said fingers whereby said actuating arms may pivotally move relative to one another without interference, and wherein said cam track includes cam surfaces defined thereon such that one of said actuating arms cooperates with one of said cam surfaces to control opening of said fingers, and the other of said actuating arms cooperates with another of said cam surfaces to control closing of said fingers.

7. A folding mechanism according to claim 6, wherein said cam track includes an opening section defining a cam surface inclined to the direction of travel of said actuating arms and which is configured for engagement by said one actuating arm to cause opening movement of said fingers, a closing section defining a cam surface inclined to the direction of travel of said actuating arms and configured for engagement said other actuating arm to cause closing movement of said fingers, and a middle section wherein said fingers are maintained in an open condition.

8. A folding mechanism according to claim 1, wherein said interconnecting means comprises a pair of meshed gears connected to said fingers.

9. A folding mechanism according to claim 8, wherein each of said fingers includes a middle portion having a beveled gear segment defined thereon for engagement with said beveled gear segment of the other of said fingers, a carton blank engaging portion extending in one direction away from said mid portion, and an actuating arm extending in a direction opposite to said carton blank engaging portion from said midportion, said actuating arm defining a cam follower at the outer end thereof.

* * * * *